US010005631B2

(12) United States Patent
Collomb et al.

(10) Patent No.: US 10,005,631 B2
(45) Date of Patent: Jun. 26, 2018

(54) LATERAL POSITIONING DEVICE FOR A SHEET ELEMENT

(71) Applicant: BOBST MEX SA, Mex (CH)

(72) Inventors: Pierre-Frédéric Collomb, Senarclens (CH); Yang Du, Prilly (CH); Daniel Hermann, Bremblens (CH); David Guillaume-Gentil, Gorgier (CH)

(73) Assignee: BOBST MEX SA (CH)

( * ) Notice: Subject to any disclaimer, the term of this patent is extended or adjusted under 35 U.S.C. 154(b) by 0 days. days.

(21) Appl. No.: 15/520,489

(22) PCT Filed: Oct. 8, 2015

(86) PCT No.: PCT/EP2015/025071
§ 371 (c)(1),
(2) Date: Apr. 20, 2017

(87) PCT Pub. No.: WO2016/062411
PCT Pub. Date: Apr. 28, 2016

(65) Prior Publication Data

US 2017/0305695 A1 Oct. 26, 2017

(30) Foreign Application Priority Data

Oct. 24, 2014 (EP) ..... 14003628

(51) Int. Cl.
*B65H 9/10* (2006.01)
*B65H 5/10* (2006.01)
(Continued)

(52) U.S. Cl.
CPC ..... *B65H 9/10* (2013.01); *B65H 5/10* (2013.01); *B41F 21/00* (2013.01); *B65H 5/00* (2013.01);
(Continued)

(58) Field of Classification Search
CPC ... B65H 7/12; B65H 7/20; B65H 9/10; B65H 9/106; B65H 9/103; B65H 9/12;
(Continued)

(56) References Cited

U.S. PATENT DOCUMENTS 6,866,261 B2 * 3/2005 Grasmuck ..... B41F 21/14 271/227
2007/0018383 A1 * 1/2007 Ohara ..... B65H 7/12 271/262
(Continued)

FOREIGN PATENT DOCUMENTS

EP 0 669 274 A1 8/1995
EP 2 657 165 A2 10/2013
(Continued)

OTHER PUBLICATIONS

International Search Report dated Jan. 19, 2016 in corresponding PCT International Application No. PCT/EP2015/025071.
(Continued)

*Primary Examiner* — David H Bollinger
(74) *Attorney, Agent, or Firm* — Ostrolenk Faber LLP

(57) ABSTRACT

A lateral positioning device (100) for a sheet element (20, 20') in a sheet element processing machine; a detector lever (130) articulated relative to a horizontal axis, which performs a descending movement from a high position to a low position; a first end (132) of the detector lever (130) contacts, in a low position of the lever, with an upper face of the sheet element. A second end (133) of the detector lever (130) is fitted with a target (135) that cooperates with a position detector (140) to generate a signal dependent on the thickness of the sheet element (20, 20') and the number of sheet elements (20, 20') present at the level of the first end (132) of the detector lever (130).

19 Claims, 8 Drawing Sheets

(51) Int. Cl.
*B65H 5/00* (2006.01)
*B41F 21/00* (2006.01)

(52) U.S. Cl.
CPC .... *B65H 2511/232* (2013.01); *B65H 2553/40* (2013.01)

(58) Field of Classification Search
CPC ..... B65H 2511/13; B65H 2511/20; B65H 2511/524; B65H 2553/612; B41F 21/14; G01B 5/061
USPC ..... 271/250, 252, 262, 263, 265.04
See application file for complete search history.

(56) References Cited

U.S. PATENT DOCUMENTS

| | | | | |
|---|---|---|---|---|
| 2011/0148025 | A1 | 6/2011 | Pan et al. | 271/10.01 |
| 2011/0210506 | A1* | 9/2011 | Yamazaki | B65H 7/02 271/265.04 |

FOREIGN PATENT DOCUMENTS

| | | | |
|---|---|---|---|
| JP | S60-47751 | U | 4/1985 |
| JP | H04-30203 | Y2 | 7/1992 |
| JP | 3426850 | B2 | 7/2003 |

OTHER PUBLICATIONS

Written Opinion dated Jan. 19, 2016 in corresponding PCT International Application No. PCT/EP2015/025071.

* cited by examiner

LATERAL POSITIONING DEVICE FOR A SHEET ELEMENT

CROSS-REFERENCE TO RELATED APPLICATIONS

The present application is a 35 U.S.C. §§ 371 national phase conversion of PCT/EP2015/025071, filed Oct. 8, 2015, which claims priority of European Patent Application No. 14003628.6, filed Oct. 24, 2014, the contents of which are incorporated by reference herein. The PCT International Application was published in the French language.

TECHNICAL FIELD

The present invention concerns a lateral positioning device for a sheet element such as a paper sheet, in particular for an introduction station. The present invention also concerns an introduction station comprising such a device, and a sheet element processing machine comprising such an introduction station.

TECHNICAL BACKGROUND

On such a feed table situated upstream of a cutting machine or a platen press, the sheet element is advanced against one or more front tabs by first means, such as endless belts or rollers, then is delivered by second means against one or more lateral positioning tabs before the front edge of the element is gripped by a series of grippers mounted on a gripper bar arranged on a chain system.

Such a device is used for precise lateral positioning of sheet elements which have already undergone one or more printing operations. Then a subsequent operation may be either a stamping process, for example hot foil stamping in a platen press, or a cutting and waste discharge operation in such a press. This subsequent operation must be performed in strict accordance with the preceding printing.

Lateral positioning devices are today used for jogging the sheets. They comprise firstly a lower roller driven in rotation and arranged transversely to the direction of movement of a sheet, close to a lateral tab situated on the left side of the table as viewed also in the direction of movement of the sheet, which is normally known as the operator's side. These devices then comprise an upper roller, vertically above the roller, mounted at the end of an arm which is in the top position at rest. This arm is lowered regularly on arrival of a sheet element against the frontal tabs, such that the upper roller grips the sheet element against the lower motorized roller which, by traction on the element, causes a correction movement as far as the lateral tab.

PRIOR ART

Document EP 0669274 describes a lateral positioning device for a sheet element on a feed table, with elements for holding the sheet element (by traction or thrust) with extended surfaces. The aim is thus to avoid damaging the grip surfaces of the sheet element. The singularity of the sheet element engaging in the lateral positioning device is here verified by a complementary device, situated at the inlet to the positioning device and comprising an upper roller and a lower roller situated in the same vertical plane. The spacing of the rollers is set to the value of the thickness of a single sheet element.

Document JP 3426850 describes a positioning device wherein the sheet element is moved laterally in one or the other transverse direction by means of a guidance device comprising two pairs of upper and lower rollers situated in the same vertical plane, each mounted on different sides. Each pair of rollers may be disengaged and the direction of rotation of the rollers may be reversed in order to allow driving of the sheet element in the required direction to correct its positioning. However, this method of gripping tends to mark sheet elements of the corrugated cardboard type, which are more susceptible to crushing than flat cardboard.

Document JPS 6047751U describes a device with a pivoting lever arm carrying, at its end directed towards the sheet element, a freely rotating roller situated above a drive wheel which is continuously rotated by an endless screw, in order to take the sheet element assembly and deliver it by traction against the lateral stop. The roller of the pivoting lever may be moved away or retracted to switch from the pull mode of moving the sheet element to the push mode of moving the sheet element.

Document JPH 0430203 (JPS62147642) describes a positioning device in which the sheet element is moved laterally in the one or the other transverse direction by means of a guidance device comprising a pair of upper and lower rollers situated in the same vertical plane. The upper roller is freely mounted and the direction of rotation of the lower roller may be reversed to allow driving of the sheet element in the required direction in order to correct its positioning. The same guidance device is present on each side of the positioning station.

SUMMARY OF THE INVENTION

One aim of the present invention is to propose a lateral positioning device without the limitations of known devices. Another aim of the invention is to propose a lateral positioning device of simple and economic design, which monitors the thickness of the sheet element during its lateral positioning.

Therefore by detection of a double thickness, it allows indication of the abnormal presence of two superposed sheet elements. More generally, the aim is to propose a device which is able to detect an abnormally great thickness of the sheet element in order to identify the abnormal presence of more than one sheet element. In fact, despite the care taken upstream to ensure that the sheet elements arrive one by one, a pair of superposed sheet elements may be delivered instead of a single sheet element, in particular because of electrostatic forces which may be present between the facing sides of two superposed elements.

Such a detection allows the operation of the processing machine to be stopped before any jamming, in order to extract the superfluous sheet element in the presence of a superposed pair of sheet elements, or more generally to extract any arrangement of sheet elements which does not conform to the expected thickness, and thus allow rapid resumption of operation of the machine. In this way, the machine stoppage time has been reduced to a minimum, which is advantageous in terms of machine efficiency.

Also, the object of the present invention is to propose a lateral positioning device adaptable to widely variable thicknesses and stiffnesses of sheet elements, ranging from flat cardboard with a known substance weight, through single layer, double layer or multi-layer corrugated cardboard, to complex multi-layer cardboard combining flat cardboard and corrugated cardboard.

According to the invention, a lateral positioning device for a sheet element in a sheet element processing machine is characterized in that it comprises a detector lever articulated relative to a horizontal axis and able to perform a descent movement from a high position to a low position, a first end of the detector lever being arranged to come into contact, in the low position, with an upper face of the sheet element, and a second end of the detector lever being fitted with a target cooperating with a position detector to generate a signal dependent on the thickness of the sheet element and the number of sheet elements present at the level of the first end of the detector lever.

Thus the lateral positioning device also comprises a system for detecting the presence of two superposed sheet elements by measuring the distance between a detector roller mounted, where applicable in free wheel, on the first end of a detector lever and the upper face of the support for receiving the sheet element.

This solution has in particular the advantage over the prior art of allowing detection of the presence of a double sheet during an operation performed simultaneously to lateral positioning, and not during a separate monitoring operation dedicated to this check only. Also, the use of a detector lever in the form of a yoke, with a support roller at the end of one its arms and a detection element at the end of the other arm, allows amplification of the movements of the support roller (detecting the upper face of the sheet element), which allows use of a less sensitive sensor at the other end of the lever. Also, this solution of moving the measurement to the other end of the lever, i.e. possibly outside the zone of the feed table covered by the sheet element, may be advantageous in terms of design and maintenance.

According to a preferred arrangement, the lateral positioning device also comprises a main lever carrying at its first end a support roller and arranged such that at the end of the descending travel of its first end, the first end of the main roller is:

either lowered according to a first configuration to press the support roller against the upper face of the sheet element so as to press the sheet element against a support surface of the feed table, or raised in a second configuration to avoid crushing the sheet element. Thus, the lateral positioning device is fully adaptable to different types of sheet elements, such as sheets of corrugated cardboard.

According to another possible configuration, the lateral positioning device also comprises a delivery wheel for pressing the sheet element against the lateral feed stop. Advantageously, such a delivery wheel has a rotation movement alternately in one direction and then the other, for cadenced individual driving of each sheet element on the support surface in the direction of the lateral feed stop. In this case, preferably, the main lever carries the support roller which is able to approach the delivery wheel on a descending movement of the first end of the main lever, while the lateral edge of the sheet element is close to or against the lateral feed stop.

According to a preferred arrangement, the second end of the detector lever is equipped with a metal target which cooperates with a detection head of the position detector which is fitted with an inductive proximity sensor. In this way, the proximity sensor contactlessly measures the distance between the metal target and the detection head, which, when the detector roller is resting on the upper face of a sheet element, allows calculation of its thickness.

Advantageously, the detector lever is coupled to the main lever. Coupling of the movement of the detector lever to the movement of the main lever allows, by a single command, the lowering of the support roller in the direction of the sheet element which is to undergo lateral positioning (with or without contact between the support roller and the sheet element) and lowering of the detector roller as far as contact with the same sheet element, in order to measure its thickness.

According to another preferred arrangement, the device also comprises a braking system allowing slowing of the descending movement of the first end of the detector lever on the descending movement of the first end of the main lever. In this way, the detector lever does not impact on the sheet element, which could damage its surface, and it avoids a rebound movement of the detector roller on the upper face of the sheet element which could disrupt and falsify the thickness measurement.

According to a preferred arrangement, the brake is a passive brake with permanent magnets. The magnets of the brake cooperate with a braking portion of the detector lever having a variable surface area as a function of the position of the detector lever. Such a Foucault brake is very easy to implement, requires no power source and, because it functions contactlessly, does not disrupt the movement of the different mechanisms and in particular the movement of the main lever and the detector lever.

Preferably, the detector lever is mounted rotatably around a shaft on which a coil spring is arranged and mounted pre-stressed so as to apply a force tending to drive down the first end of the detector lever. Such an arrangement ensures that, in the low position of the first end of the detector lever, the detector roller descends until it comes into contact with the upper face of the sheet element, so as to ensure a correct thickness measurement.

According to a preferred arrangement, in a first configuration in pull mode of the lateral positioning device which is the subject of the present invention, on lowering of the first end of the main lever, the support roller can come to rest against the upper face of a sheet element arranged on the receiver support between the support roller and the delivery wheel. This allows gripping of the sheet element which is driven by the delivery wheel in the direction of and as far as the lateral feed stop, which ensures the lateral positioning of the element against the lateral feed stop. This first configuration allows the lateral positioning device to correctly position the sheet element laterally by pulling it in the direction of the lateral feed stop Gripping of the sheet is ensured between the superposed support roller and the delivery wheel which each turn in opposite directions around parallel rotation axes.

Also advantageously, the lateral positioning device also comprises:

a pusher element arranged above the support surface. The pusher is able to move from a rest position, in which the sheet element arranged on the support surface remains below the pusher, to a working position in which the sheet element arranged on the support surface is at the same height as the pusher, and a drive system performing a reciprocating movement in the lateral direction. This cooperates with the pusher only in its working position, such that the pusher performs a reciprocating motion between a retracted position and an advanced position, and is able to push a sheet element arranged on the support surface up to a lateral position predetermined by the advanced position at the end of travel of the pusher. Thus the sheet element is positioned laterally in a predefined selected position which corresponds to the end of travel position of the pusher. The sheet element arranged on the support surface is for example first brought close to the lateral positioning device by the delivery wheel. The pusher drive system is for example a cam system.

According to a preferred arrangement, in a second configuration in push mode of the lateral positioning device which is the subject of the present invention, at the end of the descending travel of the first end of the main lever, the support roller remains above the delivery wheel and at a distance from the delivery wheel, preventing it from resting against the upper face of a sheet element arranged between the support roller and the delivery wheel. Thus in the second configuration, the support roller is in a raised position, preventing it from resting against the upper face of a sheet element arranged on the receiver support. This second configuration of the device, which is implemented as an alternative to the first abovementioned configuration, allows the lateral positioning device to position the sheet element laterally correctly by pushing it with the pusher from one of its sides, causing the sheet element to advance up to the desired position.

There are situations in which the type of sheet element to be processed by the sheet element processing machine must be changed. Due to the coexistence of the first and second configurations, the lateral positioning device according to the present invention may be adapted to any type of sheet element, and in particular to any type of cardboard such as flat cardboard and corrugated cardboard. Thus there is no need to remove a lateral positioning device of the first type from the feed table, in particular the pull type, which would thus only be suitable for compact sheet elements, and to instead install a lateral positioning device of the second type, in particular a pusher type which would be suitable for relatively thick sheet elements. Rather, the first configuration is used for sufficiently compact cardboard such that its lateral positioning by gripping between the support roller and the delivery wheel does not leave a visible mark on the surface of the cardboard. This first configuration can thus be used for cardboard sheets of any thickness, and in particular for cardboard of low thickness, for example thickness between 0.1 mm and 3 mm. The second configuration is preferably reserved for sheet elements which are less compact in thickness, and which would be marked on the surface by being gripped. In particular, the second configuration is used for voluminous elements or sheet elements containing corrugated cardboard. In practice, this second configuration can be used for sheet elements with a thickness greater than or equal to 2 mm.

In the first configuration of the lateral positioning device, the pusher is in the rest position and serves as a stop for the puller. In this way, the pusher does not act by advancing and does not push the sheet element. In this case, the sheet element reaches its desired lateral position by being firstly sandwiched and gripped between the delivery wheel and the support roller, then being driven by the rotation movement of the delivery wheel, which turns while the sheet element is still lightly gripped between the delivery wheel and the support roller. The lateral movement of the sheet element then stops when it reaches the lateral feed stop, which blocks any possibility of lateral movement.

In the second configuration, the pusher is in the working position. In this way, the pusher can push the sheet element from its initial position to its final position, which corresponds to the desired lateral position, when the pusher advances from its retracted position to its advanced position.

It is understood that for setting the desired lateral positioning by means of the lateral positioning device according to the invention, the direction of movement of the sheet element is different and reversed between the first configuration and the second configuration.

According to a preferred embodiment, the lateral feed stop and the pusher are made of the same part. Also, a sheet element arranged on the support surface is at the same height as the pusher in its rest position. In the first configuration of the device, the sheet element can be driven by a delivery wheel in the direction of and as far as the pusher, which ensures its lateral positioning. This advantageous configuration allows correct lateral positioning of a sheet element, either by pulling it to the position, or by pushing it up to the desired position by means of the part which forms both the lateral feed stop and the pusher.

The invention also relates to an introduction station comprising the lateral positioning device with one or more of the technical characteristics described on one of the operator's side or the side opposite the operator. Advantageously, such an introduction station also comprises a further lateral positioning device arranged on the other of the operator's side or the side opposite the operator.

The invention also concerns a sheet element processing device comprising a device with one or more of the technical characteristics described, mounted in an introduction station upstream of a processing station.

DESCRIPTION OF THE DRAWINGS

The invention will be better understood and its various advantages and characteristics will arise more clearly from the description below of the non-limiting exemplary embodiment, with reference to the attached Figures in which.

DETAILED EXPLANATION OF PREFERRED EMBODIMENTS

Figure 5:
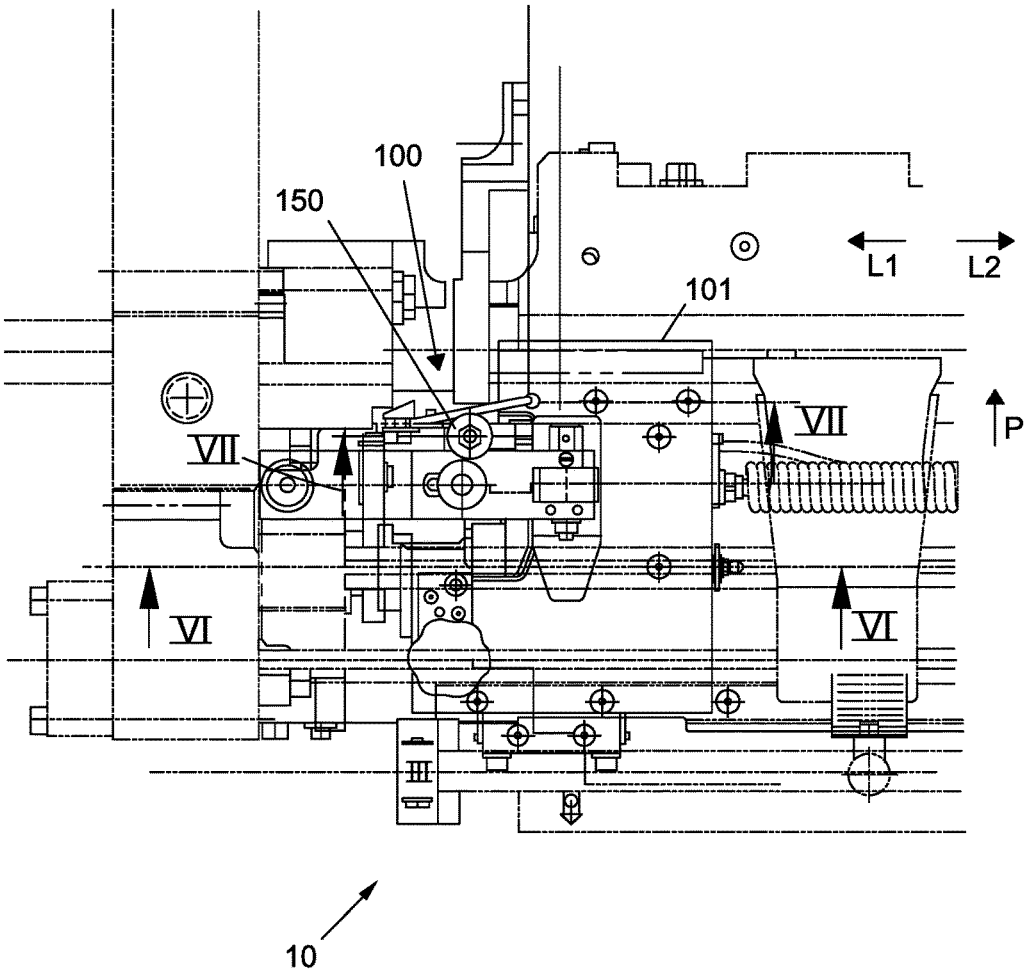
FIG. 5 is a partial view from above of a feed table of the lateral positioning device in FIGS. 1 to 4.

In the present text, the term "lateral" designates a direction perpendicular to the direction of advance of the sheet elements, such as paper sheets, in a processing machine, and in particular in an introduction station 10 partly visible in FIG. 5. In FIG. 5, arrow P designates the direction of advance of the sheets to be processed from upstream to downstream, arrow L1 designates the left lateral side or CC for "operator's side", and arrow L2 designates the right lateral side, or COC for "side opposite the operator".

The lateral positioning device 100 visible in FIG. 5 is in this example located on the operator's side and intended to ensure the good lateral positioning of a sheet element, such as a sheet of printed cardboard, before its processing, such as cutting by platen, while the good longitudinal positioning (in direction A) is ensured by a front positioning device (not shown).

The operating principle of the lateral positioning device 100 is explained in relation to FIGS. 1 to 4 on which the lateral positioning device 100 is viewed from upstream. A delivery wheel 102 which turns rhythmically alternately clockwise and anticlockwise forms the drive means for introducing a sheet element 20; in FIGS. 1 and 2, the lateral positioning device 100 is in the first configuration, able to perform the lateral adjustment of a sheet element 20 which may be of widely varying thickness, in particular between 0.2 mm and 4 mm. Conventionally, this is a flat printed cardboard with a multitude of subassemblies, which will be precut in the next unit (not shown) to form the cardboard flaps which after assembly will constitute the packaging.

Figure 1:
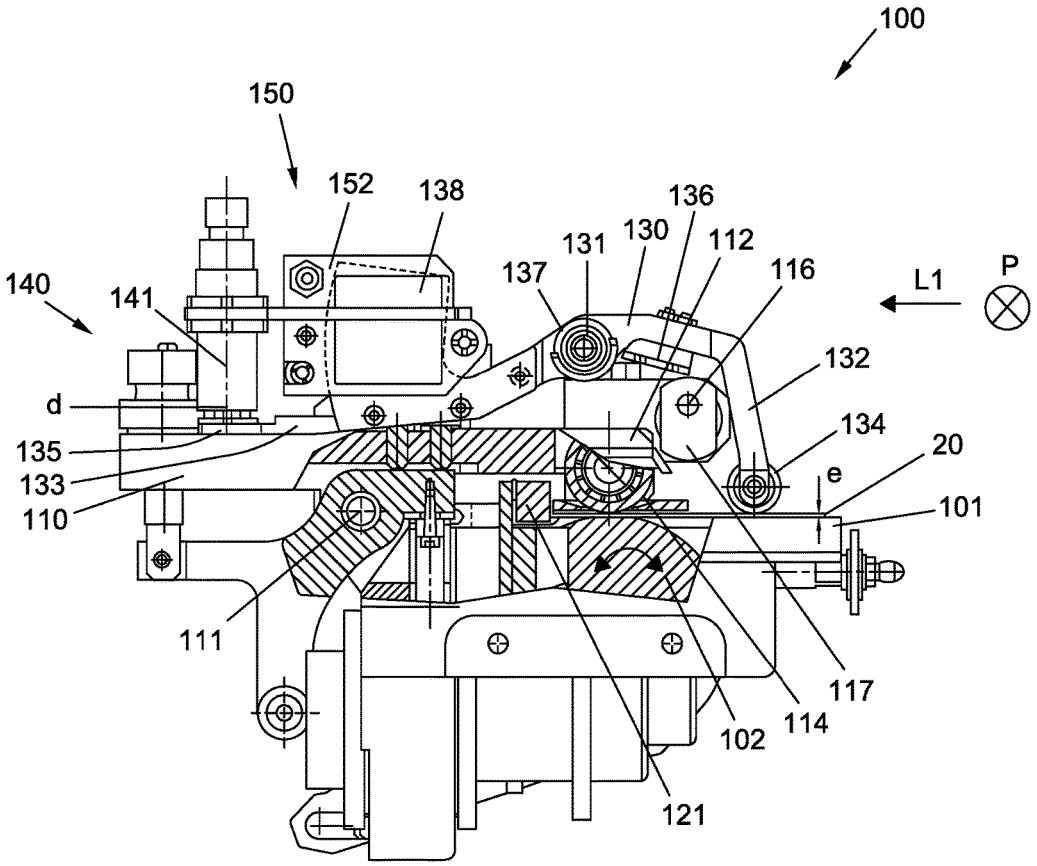
FIG. 1 illustrates in side view, partly in cross section, a lateral positioning device according to the invention in the first configuration, with the first end of the main lever lowered.

In FIG. 1, the sheet element 20 rests on a support surface front abutment 101 with a window at the position of the delivery wheel 102, to allow the periphery of the delivery wheel to come into contact with the lower face of the sheet 20 in order to drive the sheet from the lateral side L1 using the delivery wheel 102. The sheet is pulled from the lateral side L2 via the COC tab. A main lever 110 mounted rotatably around direction P on its pivot 111 of horizontal axis, at its first end 112 (on the right in FIGS. 1 to 4 and 6) has a support roller 114, here shown in the form of a roller bearing, placed above the receiver support. Here the main lever 110 is articulated around a horizontal axis. On swiveling of the main lever 110 in the direction of lowering of the first end 112, the arrangement allows the support roller 114 to be aligned with the delivery wheel 102 (see FIGS. 1 and 3) with the two axes of rotation of the support roller 114 and the delivery wheel 102 parallel. More precisely, in the lowered position of the first end 112, the rotation axis of the support roller 114 is aligned with the rotation axis of the delivery wheel 102, as shown on FIG. 1, while the high position of the first end 112 is visible on FIG. 2.

In FIG. 1, in the low position of the first end 112, a slight downward back-pressure is applied by the support roller 114 so as to lightly grip the sheet 20 between the delivery wheel 102 and the support roller 114, and by this gripping ensure transfer of the sheet in the direction of the rotation movement of the delivery wheel 102, which is now anticlockwise, until the sheet comes to rest with its lateral edge against the lateral feed stop 121 facing the delivery wheel 102. In this position, the sheet 20 is arranged laterally in the desired position. The low position of the first end 112 is first adjusted according to the thickness of the sheet 20. The main lever 110 is driven by an electric motor and cams, allowing its pivoting with a cadenced rise and fall following the machine cycle for each packaging element 20.

Thus, in the first configuration, the lateral positioning device 100 functions in pull mode, since the sheet is wedged in the desired lateral position by pulling the packaging element 20, gripping and advancing it between the support roller 114 and the delivery wheel 102 until the packaging element 20 comes to rest against the lateral feed stop 121.

In parallel with the cadenced movement of the main lever 110, there is a cadenced movement in the same rhythm of a secondary lever coupled to the main lever 110 and called the detector lever 130. This detector lever 130 is parallel to the main lever, and is situated next to and upstream of the main lever 110 relative to the direction of advance P of the sheet elements 20. The detector lever 130 swivels around the direction P on its pivot 131 of horizontal axis, and at its first end 132 (at the right in FIGS. 1 to 4 and 6) has a detector roller 134 formed by an idler wheel placed above the support surface 101.

On swiveling of the main lever 110 in the direction of lowering of the first end 112, the arrangement allows the first end 132 of the detector lever 130 to descend in order to enable the detector roller 134 to come to rest precisely against the upper face of the sheet 20, as shown in FIG. 1. In this position, the second end 133 of the detector lever 130 is raised. A metal target 135 is arranged on this second end 133. This metal target 135 belongs to a proximity detector 140, which is for example an inductive sensor and is situated below a detection head 141. This detector 140 is calibrated to measure the distance d between its lower face 142 and the metal target 135. The value d, which is measured when the detector roller 134 touches the sheet 20 allows very precise calculation of the thickness e of this packaging element.

The mechanical coupling between the main lever 110 and the detector lever 130 is ensured, on lifting of the main lever 110, via a pin 116 arranged on the side of the first end 112 of the main lever 110 and protruding in the upstream direction. This pin 116 extends over a sufficient length to be able to cooperate with the first end 132 of the detector lever 130 by pressing under a stud 136 present on this first end 132 of the detector lever 130, such that when the first end 112 of the main lever 110 rises, the pin 116 pushes the stud 136 up and causes it to rise, driving the first end 132 of the detector lever 130 in its travel.

When the main lever 110 descends, the descent of the pin 116 breaks the support of the stud 136 by the pin 116, leaving the first end 132 of the detector lever 130 free to descend at least as low as the position of the pin 116. The arrangement of the levers 110 and 130 is such that, when the first end 112 of the main lever 110 is in the lowest position, the support roller 114 is in contact with the sheet 20, the pin 116 is lower than the stud 136, while the detector roller 134 is in contact with the upper face of the sheet 20.

In order to force down the first end 132 of the detector lever 130 when the stud 136 is not coupled to the pin 116, the shaft 131 about which the detector lever 130 pivots is surrounded by a pre-stressed coil spring 137. This prestressing also allows generation of a support force guaranteeing the contact of the detector roller 134 on the sheet 20 and hence a correct thickness measurement.

A selection system with the pin 116 and support 117 for the pin 116 allows the detector lever 130 to be raised irrespective of the position of the main lever 110.

To ensure contact between the detector roller 134 and the sheet 20 without marking the upper face of the sheet, arrangements are made to slow down the descending movement of the second end 132 of the detector lever 130. To this end, a passive braking system 150 is used. In the embodiment shown, this is a permanent magnet brake or Foucault brake, functioning as follows: between the second end 133 and the pivot 131, the detection lever 130 has a braking portion 138 formed by a metal plate oriented vertically upwards. Also, next to the detection head 141, the device 100 has two permanent magnets in the form of a frame 152 which are parallel to each other and extend vertically, delimiting an air gap in which the braking portion 138 engages. The surface area of the braking portion 138 in the gap is variable and increases during the descending movement of the detector roller 134, which slows the descent.

By monitoring the value of the thickness e measured for each new packaging element 20 arriving at the lateral positioning device 100, where necessary the processing machine can be stopped so that an operator can verify and extract an incorrect sheet 20 or incorrect set of sheets 20.

Figure 2:
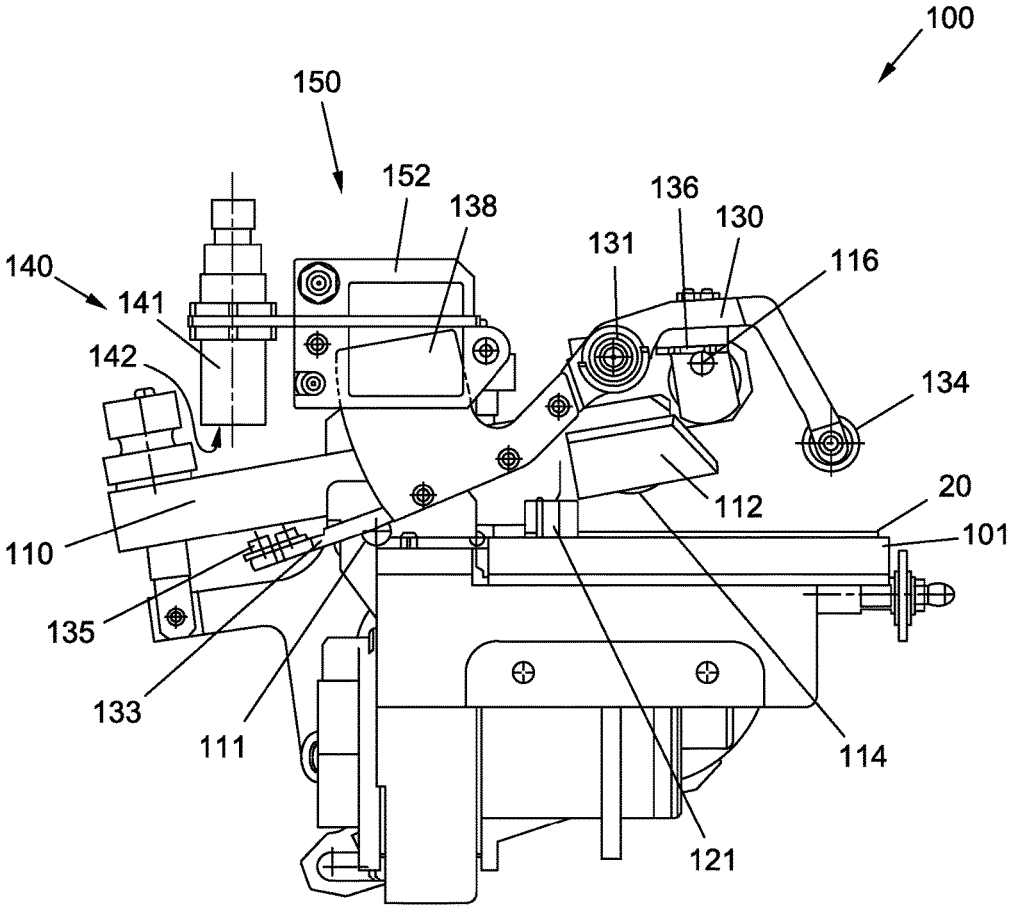
FIG. 2 is a side view of the lateral positioning device of FIG. 1 in the first configuration, with the first end of the main lever raised.
Figure 3:
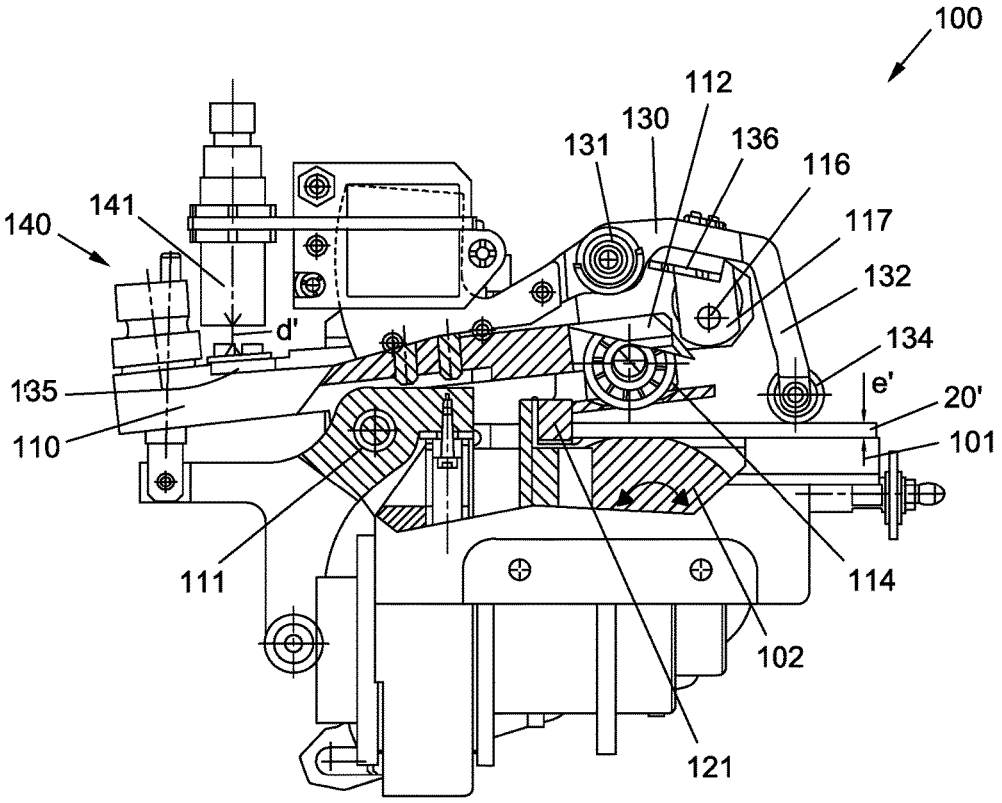
FIG. 3 illustrates in side view, partly in cross section, the lateral positioning device in FIG. 1 in the second configuration, with the first end of the main lever lowered.

In FIG. 3, the main lever 110 has been adjusted such that, in the low position of the first end 112, a slight back-pressure is exerted by the support roller 114 on the sheet 20' which is thicker than the sheet 20 of FIGS. 1 and 2.

Figure 4:
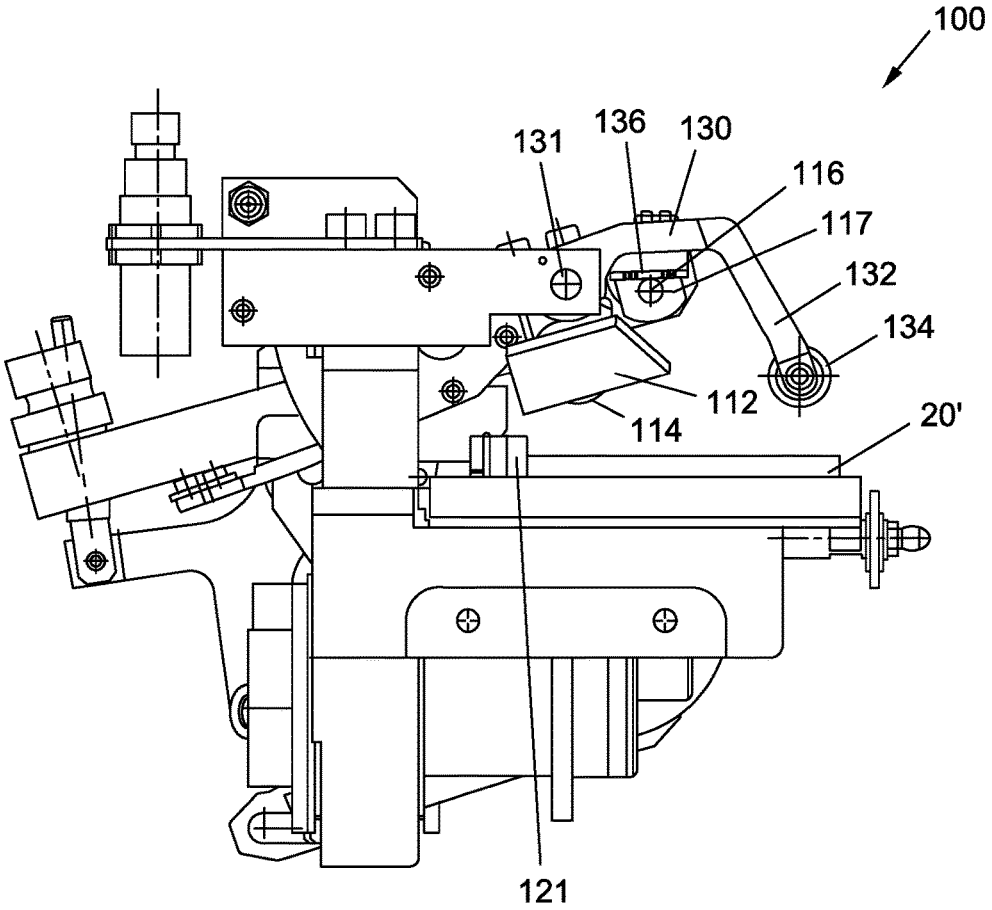
FIG. 4 is a side view of the lateral positioning device in the second configuration, with the first end of the main lever raised.

Also, the lateral positioning device 100 functions in a second configuration shown in FIGS. 3 and 4. In this case, the aim is to avoid the pressurized support of the support roller 114 on the sheet 20', for example because this packaging element 20' has a low density, its surface is easily marked by an imprint under the pressure of a roller. This is the case in particular if the packaging element 20' contains one or more layers of corrugated cardboard. In the example shown, this packaging element 20' has a thickness e' which is greater than the thickness e of the sheet 20 shown in FIGS. 1 and 2. This thickness e' corresponds to a distance d' between the metal target 135 and the detection head 141.

In this second configuration, the support roller 114 is raised relative to its position in the first configuration, so that it is not able to touch the upper surface of the sheet 20' when the first end 112 of the main lever 110 is lowered. To compensate for this uplift of the support roller 114 and still allow the detector roller 134 to descend to the upper face of the sheet 20', the height position of the pin 116 has also been shifted by turning its support 117 through 180° around a horizontal axis, parallel to the axis of rotation of the delivery wheel 102.

The lateral feed stop acts as a pusher element 121 and is arranged just above the support surface 101 and on the other side of the delivery wheel 102 relative to the support roller 134. This pusher element 121 has a thrust face against which the lateral edge of the sheet 20' comes to rest. This pusher 121 executes a horizontal translation movement (from left to right in FIGS. 3 and 4) from a retracted position, shown in FIGS. 3 and 4, to an advanced position which is set such that at the end of travel, the sheet 20' is arranged laterally in the desired position.

Thus in the second configuration, the lateral positioning device 100 functions in pusher mode, wherein the sheet 20' is wedged in the desired lateral position by pushing this packaging element 20', the pusher 121 is transferred from the retracted position to the advanced position until the packaging element 20' is brought into the lateral position corresponding to the end of travel (advanced position) of the pusher 121.

In this second configuration, the thickness of the sheet present on the feed table is monitored in the same way as described above in relation to the first configuration. To understand the transition from the first configuration (pull mode) to the second configuration (push mode) and vice versa, reference is made to FIGS. 5 to 8.

Figure 6:
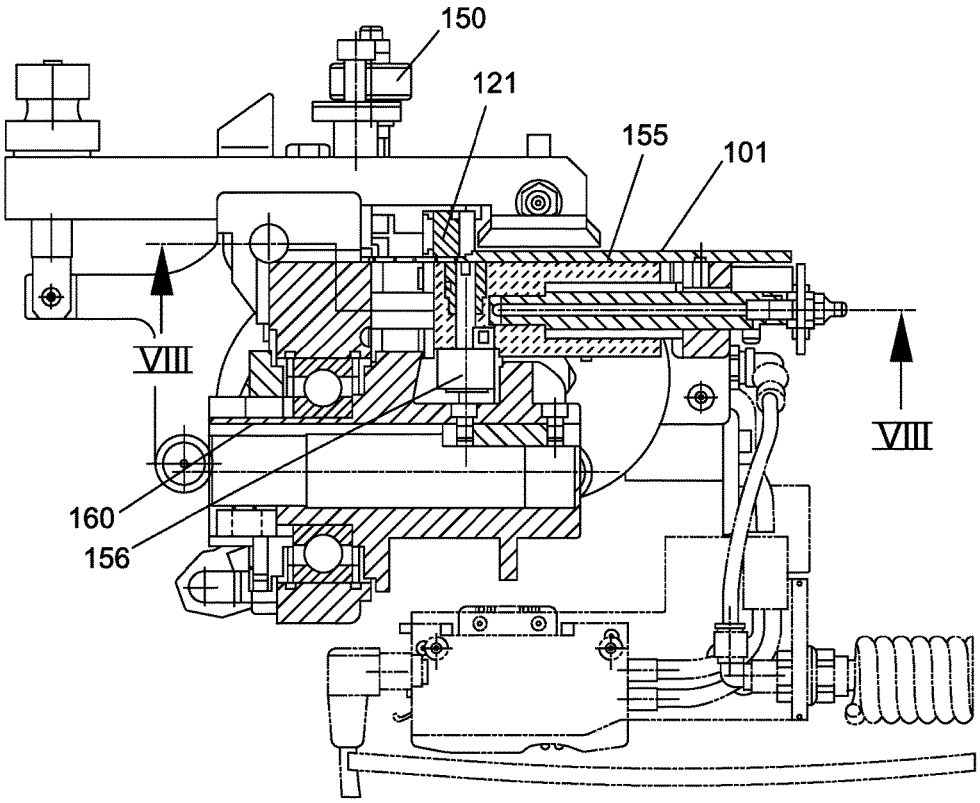
FIG. 6 is a section view in direction VI-VI of the lateral positioning device in FIG. 5.
Figure 7:
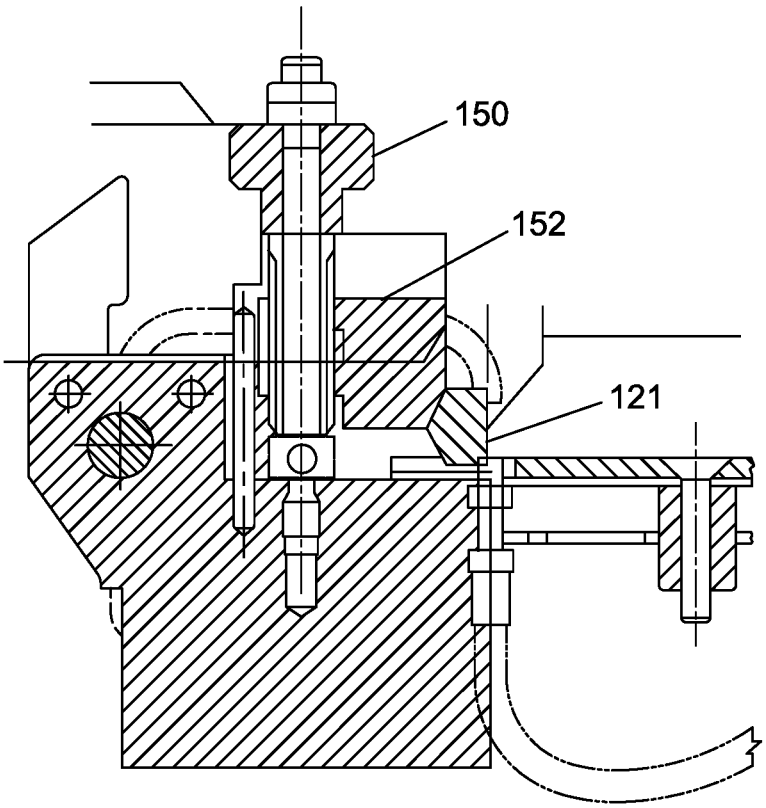
FIG. 7 is a section view in direction VII-VII of the lateral positioning device in FIG. 5.
Figure 8:
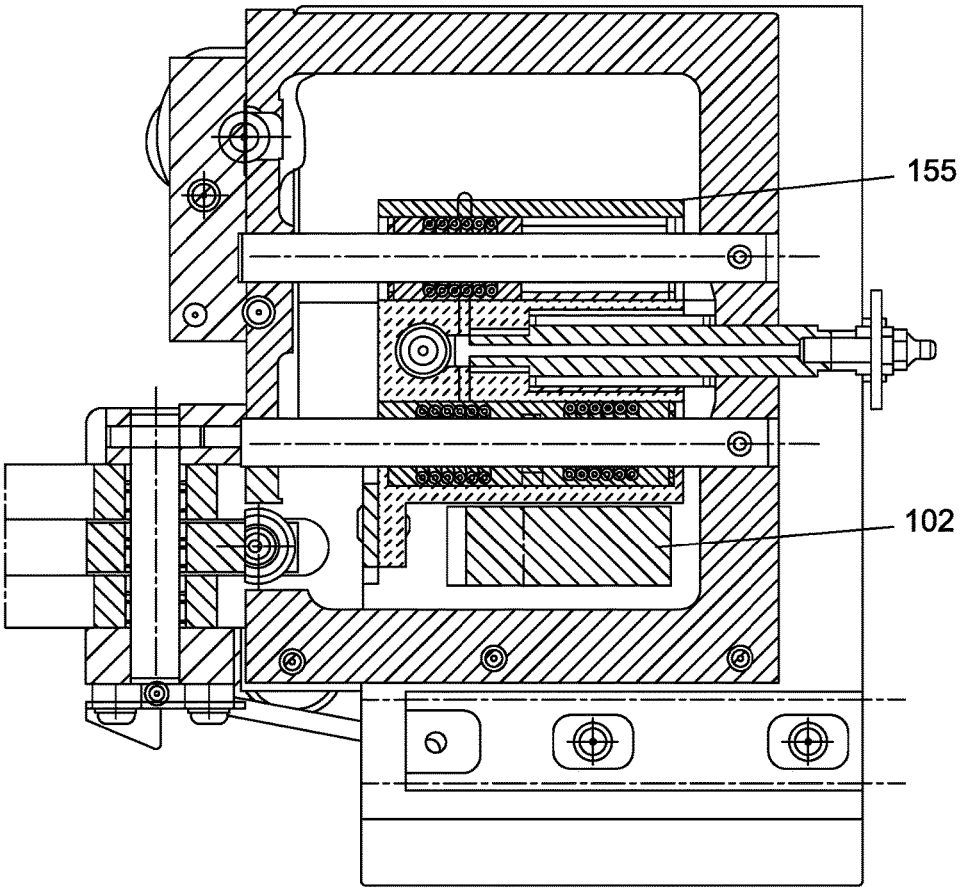
FIG. 8 is a section view in direction VIII-VIII of FIG. 6.

As is shown in FIG. 7, the pusher 121 is blocked in the forward position and serves as a stop for the puller. An adjustment screw 150 allows, by its rotation, the raising or lowering of an adjustment support 152 with a beveled lower edge which cooperates with a beveled upper edge of the block forming both the pusher and the lateral feed stop 121. Thus the descent of the adjustment support 152 causes the pusher 121 to advance in horizontal translation towards the right in FIGS. 6 and 7.

The pusher 121 is fixedly attached to the slider 155, which is itself fixed to the roller of the cam 156 (see FIG. 6). The position of FIGS. 6 and 7 corresponds to the second above-mentioned configuration of the lateral positioning device. In this case, the cam roller 156 is housed in a receiver space for the cam 160, which moves in a permanent cyclic movement, in a position allowing a reciprocating movement of slider 155 between the right and left. This reciprocating movement allows the pusher 121 to perform the positioning of the sheet 20' by pushing. To transfer to the first configuration, the adjustment support 152 is lowered via the adjustment screw 150, causing the pusher 121 to advance towards the right into a position which remains in the receiver space of the cam 160, but this time the pusher 121 is not able to follow the movement of the cam 160 which turns idly because the cam 160 is no longer driving the pusher 121.

The introduction station 10 with the lateral positioning device 100 just described preferably comprises a further lateral positioning device located on the other side, at the same axial position as the lateral positioning device 100. Thus if the lateral positioning device 100 is on the operator's side, the additional lateral positioning device is on the side opposite the operator. In the first variant, the additional lateral positioning device is identical to the lateral positioning device 100, apart from adaptation to the side opposite the operator by modifying the structure of the lateral positioning device 100 by symmetry relative to the median vertical plane of the support surface 101. In a second variant, the additional lateral positioning device does not comprise the detector lever 130 and all elements of the system for detecting the presence of two superposed sheet elements and allowing monitoring of the thickness of the sheet 20 or 20'.

Advantageously, the additional lateral positioning device comprises (elements identical to those of the lateral positioning device 100 carry the same reference numeral):

- a lateral feed stop 121 protruding upward from the upper face of the support surface 101,
- a main lever 110 carrying at its first end a support roller 114 able to approach the delivery wheel 102 on a descending movement of the first end of the main lever 110, when the lateral edge of the sheet 20, 20' is close to or against the lateral feed stop 121.

According to another preferred arrangement, such an additional lateral positioning device also comprises:

- a delivery wheel 102 for the sheet elements, having a rotation movement alternately in one direction or is then the other, for cadenced driving of each packaging element 20, 20' in the direction of the lateral feed stop 121.

Preferably such an additional lateral positioning device also comprises:

- the pusher 121 arranged above the support surface 101, the pusher 121 is able to move from a rest position to a working position in which a packaging element 20, 20' arranged on the support surface 101 is at the same height as the pusher 121, and
- a drive system, in particular a drive by cams, performing a reciprocating movement in the lateral direction and cooperating with the pusher 121 only in its working position, such that the pusher 121 performs a reciprocating movement between a retracted position and an advanced position, and the pusher is able to push a packaging element 20 and 20' arranged on the feed table to a lateral position predefined by the advanced position (end of travel of pusher 121).

On use of the introduction station 10, several possibilities exist according to the size and type of packaging element supplied to the feed table. According to a second possibility, only the lateral positioning device 100 or only the additional lateral positioning device is used, each of which is placed either in the first configuration or in the second configuration.

The invention claimed is:

1. A lateral positioning device for positioning a sheet element in a sheet element processing machine, the device comprising:

a detector lever articulated relative to a horizontal axis and configured to perform a descending movement from a high position to a low position;

a first end of the detector lever configured and operable to be articulated, in the low position, to contact an upper face of the sheet element;

a second end of the detector lever being fitted with a target located and configured for cooperating with a position detector to generate a signal dependent on and corresponding to a thickness of the sheet element and to a quantity of sheet elements present at the level of the first end of the detector lever in the low position; and a braking system configured and operable to slow the descending movement of the detector lever.

2. The device according to claim 1, wherein the braking system comprises a Foucault brake.

3. The device according to claim 2, further comprising in a second configuration, at the end of descending travel of the first end of the main lever, the support roller remains above the delivery wheel and at a distance from the delivery wheel, preventing the support roller from resting against the upper face of the sheet element then between the support roller and the delivery wheel.

4. The device according to claim 3, wherein in the second configuration, the pusher is in the working position thereof.

5. A sheet element processing machine comprising a device according to claim 3, mounted in an introduction station upstream of a processing station.

6. The device according to claim 1, further comprising:

a shaft at the horizontal axis around which the detector lever is rotatably mounted; and return urging device positioned at the shaft and configured to exert a force for generating the descending movement of the detector lever.

7. The device according to claim 1, wherein the second end of the detector lever comprising the metal target cooperates with a detection head of the position detector and the detection head comprises the position detector configured as an inductive proximity sensor.

8. A sheet element processing machine comprising a device according to claim 1, mounted in an introduction station upstream of a processing station.

9. A lateral positioning device for positioning a sheet element in a sheet element processing machine, the device comprising:

a detector lever articulated relative to a horizontal axis and configured to perform a descending movement from a high position to a low position;

a first end of the detector lever configured and operable to be articulated, in the low position, to contact an upper face of the sheet element;

a second end of the detector lever being fitted with a target located and configured for cooperating with a position detector to generate a signal dependent on and corresponding to a thickness of the sheet element and to a quantity of sheet elements present at the level of the first end of the detector lever in the low position;

a main lever having a main first end and comprising a support roller carried at the main first end of the main lever;

the main lever is located and configured such that at the end of descending travel of the first end of the main lever; and the first end of the main lever is configured in at least one of:

a first lowered configuration at which the first end of the main lever is located and configured for pressing the support roller against the upper face of the sheet element and so as to drive the sheet element laterally, and a second raised configuration at which the first end of the main roller is positioned and configured to position the support roller to avoid crushing the sheet element.

10. The device according to claim 9, wherein the detector lever is mechanically coupled to the main lever and the detector lever is movable by and along with the main lever.

11. The device according to claim 10, further comprising a selection system located and configured for allowing the detector lever to be raised off the sheet element irrespective of the position of the main lever.

12. The device according to claim 9, further comprising a delivery wheel located and configured for moving the sheet element flush against a lateral feed stop.

13. The device according to claim 12, further comprising in a first configuration, the support roller is located and configured for coming to rest against the upper face of a sheet element arranged on a support surface between the support roller and the delivery wheel, to allow gripping of the sheet element which is driven by the delivery wheel in a direction of and as far as the lateral feed stop for lateral positioning of the sheet element against the lateral feed stop.

14. The lateral positioning device of claim 9, further comprising a braking system configured and operable to slow the descending movement of the detector lever.

15. The lateral positioning device of claim 14, wherein the detector lever is mechanically coupled to the main lever and the detector lever is movable by and along with the main lever.

16. A lateral positioning device for positioning a sheet element in a sheet element processing machine, the device comprising:

a detector lever articulated relative to a horizontal axis and configured to perform a descending movement from a high position to a low position;

a first end of the detector lever configured and operable to be articulated, in the low position, to contact an upper face of the sheet element;

a second end of the detector lever being fitted with a target located and configured for cooperating with a position detector to generate a signal dependent on and corresponding to a thickness of the sheet element and to a quantity of sheet elements present at the level of the first end of the detector lever in the low position;

a pusher located above a support surface, the pusher being configured to move from a rest position thereof to a working position thereof in which a sheet element arranged on the support surface is at the same height as is the pusher; and a drive system perform a reciprocating movement in the lateral direction, across a movement path of the sheet, the drive system cooperates with the pusher only in the working position of the drive system such that the pusher performs a reciprocating motion between a retracted position and an advanced position, wherein the pusher in the advanced position is arranged to push a sheet element arranged on the support surface up to a lateral position predetermined by the advanced position.

17. The device according to claim 16, wherein, in the first configuration, the pusher is in the rest position thereof.

18. The device according to claim 17, wherein in the second configuration, the pusher is in the working position thereof.

19. The lateral positioning device of claim 16, further comprising a braking system configured and operable to slow the descending movement of the detector lever.

* * * * *